US006128362A

United States Patent [19]

Brauers et al.

[11] Patent Number: 6,128,362

[45] Date of Patent: Oct. 3, 2000

[54] X-RAY IMAGING DEVICE PROVIDED WITH A PHOTOCONDUCTOR

[75] Inventors: Andreas Brauers; Ulrich Schiebel, both of Aachen, Germany

[73] Assignee: U.S. Philips Corporation, New York, N.Y.

[21] Appl. No.: 08/940,684

[22] Filed: Sep. 30, 1997

[30] Foreign Application Priority Data

Oct. 4, 1996 [DE] Germany ..... 196 40 946

[51] Int. Cl.[7] ..... G03G 5/14

[52] U.S. Cl. ..... 378/28; 430/65

[58] Field of Search ..... 378/28, 31, 32, 378/98.8; 258/370.09, 370.01, 370.12, 370.14; 430/65, 84, 85, 86, 95, 64

[56] References Cited

U.S. PATENT DOCUMENTS

| | | | |
|---|---|---|---|
| 3,621,248 | 11/1971 | Regensburger | 250/65 ZE |
| 4,315,063 | 2/1982 | Fukuda et al. | 430/65 |
| 4,442,149 | 4/1984 | Bennett | 428/53 |
| 4,763,002 | 8/1988 | Zermeno et al. | 250/370.01 |
| 4,939,759 | 7/1990 | Rupp et al. | 378/32 |
| 5,396,072 | 3/1995 | Schiebel et al. | 250/370.09 |
| 5,436,101 | 7/1995 | Fender et al. | 430/65 |
| 5,510,626 | 4/1996 | Nelson et al. | 250/591 |

FOREIGN PATENT DOCUMENTS

| | | | |
|---|---|---|---|
| 57167030 | 10/1982 | Japan | G03G 5/04 |

*Primary Examiner*—David P. Porta
*Attorney, Agent, or Firm*—Dwight H. Renfrew, Jr.

[57] ABSTRACT

The so-called memory effect occurring in a device for forming X-ray images by means of an X-ray image converter which includes a photoconductor for converting the X-rays into a charge pattern can be reduced by means of a trapping layer which is provided on at least one of the two sides of the photoconductor and reduces the current of charge carriers injected into the photoconductor from this side.

20 Claims, 2 Drawing Sheets

X-RAY IMAGING DEVICE PROVIDED WITH A PHOTOCONDUCTOR

BACKGROUND OF THE INVENTION

1. Field of the Invention

The invention relates to a device for forming X-ray images by means of an X-ray image converter which includes a photoconductor which at least partly absorbs the X-rays and is provided on a substrate which acts as an electrode, which device includes means for charging the photoconductor with a given polarity so that an electric field having a defined direction is generated in the photoconductor. The invention also relates to an X-ray imaging apparatus including such a device.

2. Description of the Related Art

An ideal photoconductor is an insulator when it is not exposed. It is merely in the case of an exposure or an irradiation by X-rays that it becomes conductive, i.e. the more so as the radiation intensity is higher. Thus, at the irradiated locations the charge density produced by a previous charging operation is reduced in conformity with the dose incident at those locations. The two-dimensional charge pattern thus produced on the surface of the photoconductor, essentially corresponding to the spatial distribution of the X-ray dose (latent image or charge image) is converted into electric signals by a read unit, which signals can be amplified, filtered, digitized and stored. The signals are thus rendered suitable for digital image processing.

From EP-A 0342760 which corresponds to U.S. Pat. No. 4,939,759, it is known that the so-called memory effect can occur due to defect spots in the photoconductor. Due to these defect spots a given conductivity remains in their vicinity after irradiation; consequently, structures of the preceding X-ray image appear as artefacts when the next X-ray image is formed. The memory effect is more pronounced as the dose of the preceding exposure was higher. Therefore, it becomes manifest only in the X-ray images; it does not have a disturbing effect in the case of X-ray fluoroscopy where a substantially lower X-ray dose is generated per individual image. In the known device the artefacts caused by the memory effect are eliminated or reduced by way of a correction based on software.

SUMMARY OF THE INVENTION

It is an object of the present invention, however, to reduce the memory effect itself. This object is achieved according to the invention in that between the substrate and the photoconductor and/or on the side of the photoconductor which is remote from the substrate there is provided a trapping layer for reducing the charge carriers injected into the photoconductor from the outside.

The invention is based on the recognition of the fact that a significant cause of the memory effect can be found in the charge carrier currents injected into the photoconductor from the outside or the boundary surfaces. The trapping layer (layers) reduces the number of charge carriers injected into the photoconductor and hence also the memory effect. The trapping layers, however, do not have a direct effect on the defect spots which may cause the memory effect in conformity with EP-A-0342760.

The requirements imposed on the trapping layer are dependent on the polarity with which the photoconductor is charged. When the substrate is negative, an electron trapping layer must be provided between the substrate and the photoconductor and/or a hole trapping layer must be provided on the side of the photoconductor which is remote from the substrate. However, if the substrate is positive a hole trapping layer must be provided between the substrate and the photoconductor and/or an electron trapping layer must be provided on the side which is remote from the substrate.

It is to be noted that U.S. Pat. No. 5,436,101 already discloses an X-ray image converter with a selenium photoconductor which is provided with a hole trapping layer of a selenium arsenic alloy (with 0.1–33% by weight of arsenic) at both sides of the photoconductor. The aim is to enable the photoconductor to operate in the case of positive charging (where the substrate is negative) as well as in the case of negative charging (with a positive substrate). The two layers offer an improvement in respect of negative charging of the photoconductor, so that the photoconductor behavior is then the same as in the case of positive charging. The properties of the photoconductor are not improved for positive charging of the photoconductor; its dynamic range is even limited. According to the invention, however, only one polarity is envisaged for charging (preferably positive charging in the case of a selenium photoconductor) and the invention improves the properties of the photoconductor for this charging polarity.

It is also to be noted that EP-A 0 588 397 which corresponds to U.S. Pat. No. 5,396,072, discloses an X-ray image detector for X-ray fluoroscopy which includes a sensor matrix whose sensor elements detect the charge carriers from the area of a photoconductor which is situated thereabove. In order to reduce the dark discharge rates which disturb fluoroscopy, selenium layers with a dopant are provided to both sides of the selenium photoconductor, so that one layer traps holes and the other layer traps electrons.

In comparison with the photoconductor, trapping layers have a low electrical conductivity for the charge carriers of one type (for example, electrons) whereas they have a high conductivity for charge carriers of the opposite type (holes). In a further embodiment of the invention this behavior can be achieved in that the material of the trapping layer deviates from the material of the photoconductor by doping with an additional substance so that defect spots for trapping the injected charge carriers, are formed in the trapping layer.

In a preferred further embodiment of the invention the side of the trapping layer which is remote from the photoconductor is provided with a layer whose thickness is substantially smaller than that of the photoconductor but has the same physical composition. This layer acts as a buffer layer which separates the layers having an imaging function from the boundary surfaces, notably at the substrate.

In a further embodiment of the invention a passivation layer is provided on the side of the photoconductor which is remote from the substrate. Such a passivation layer forms a mechanical and chemical protection for the surface of the photoconductor and, moreover, reduces the number of charge carriers that can penetrate the photoconductor.

The photoconductor in a preferred embodiment of the invention consists mainly of selenium, the substrate consisting of aluminium whose surface facing the photoconductor is oxidized and the means for charging the photoconductor being arranged so that the potential on the side which is remote from the substrate is positive in relation to the potential of the substrate. If the photoconductor were instead charged to a negative potential, a significantly less attractive behavior would occur.

The photoconductor in a further embodiment of the invention consists mainly of lead oxide, the substrate consisting of aluminium whose surface facing the photoconductor is oxidized, and the means for charging the photoconductor being arranged so that the potential on the side which is remote from the substrate is negative in relation to the potential of the substrate. As opposed to a selenium photoconductor, in the case of a lead oxide photoconductor the more attractive results are obtained by charging to a negative potential.

Generally, more attractive results are obtained by charging the photoconductor surface to a potential which attracts those charge carriers having a charge that are less easily injected from a contact with a conductor than by charging to a potential which attracts charge carriers having the other charge that are more easily injected.

The electron trapping layer in a further embodiment of the invention contains selenium with a chlorine doping of less than 1000 ppm. In contrast therewith, in a further embodiment of the invention for trapping positive charge carriers (holes) the hole trapping layer contains selenium with a sodium or hydrogen doping of less 2000 ppm.

In an embodiment of the invention which is suitable for a lead oxide photoconductor the trapping layers contain lead oxide with more and less oxygen atoms, respectively, than lead atoms. Such a layer can trap electrons in the case of an oxygen excess while in the case of an oxygen deficiency it can trap holes.

The device according to the invention can be advantageously used for an X-ray imaging apparatus. It is then assumed that an X-ray imaging apparatus includes an X-ray source for generating X-rays, an X-ray image converter which includes a photoconductor which at least partly absorbs the X-rays and is provided on a substrate acting as an electrode, means for charging the photoconductor with a single polarity so that an electric field having a defined direction is generated in the photoconductor, and a read unit for reading the charge pattern generated in the X-ray image converter by the X-rays; the reduction of the memory effect is then achieved in that a trapping layer for reducing the charge carriers injected into the photoconductor from the outside is provided between the substrate and the photoconductor and/or on the side of the photoconductor which is remote from the substrate.

BRIEF DESCRIPTION OF THE DRAWING

The invention will be described in detail hereinafter with reference to the drawings. Therein.

DETAILED DESCRIPTION OF THE PREFERRED EMBODIMENTS

Figure 1:
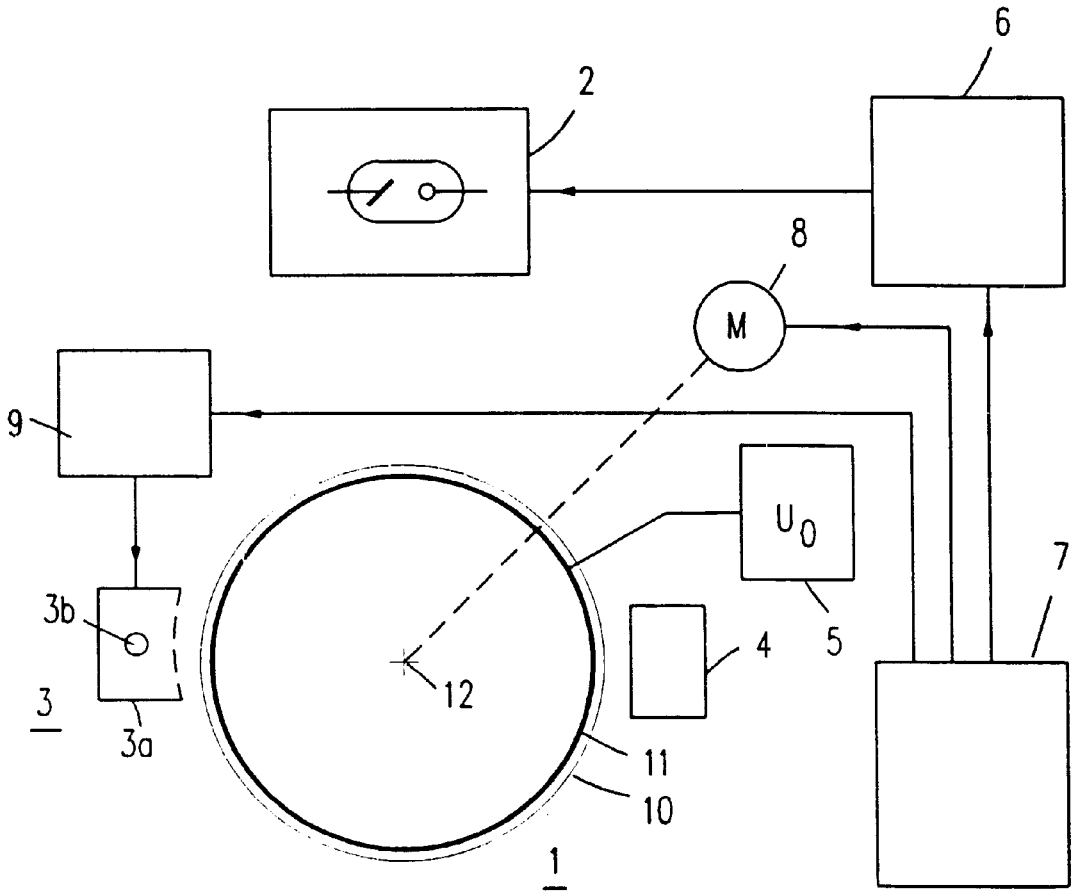
FIG. 1 shows diagrammatically an X-ray apparatus in which the invention can be used.

FIG. 1 shows diagrammatically a part of an X-ray imaging apparatus in which the invention can be used. The reference numeral 1 denotes an X-ray image converter which includes a cylindrical or drum-shaped supporting member 11 of aluminium, the outer side of which is provided with a coating 10 which includes inter alia a photoconductor.

The supporting member 11 acts as a substrate and is connected to a direct voltage source 5 which supplies a negative direct voltage of, for example 1.5 kV with respect to ground.

Prior to an X-ray exposure, the X-ray image converter 1 with the photoconductor is uniformly charged to a defined potential, for example 0 volts, a motor 8 ensuring that the supporting member 11 rotates about its longitudinal axis 12 so that uniform charging is achieved. Charging is performed by means of a charging device which includes a corona unit 3 and a direct voltage generator 9, or a power supply unit, which supplies a direct voltage for the corona unit 3. The corona unit 3 extends perpendicularly to the plane of drawing, so parallel to the axis of rotation of the supporting member 11 and over the entire length thereof. It includes a grounded housing 3*a* which has a U-shaped cross-section and whose open side faces the photoconductor. The housing 3*a* accommodates a wire 3*b*, a grid which is also grounded preferably being arranged between said wire and the photoconductor. The wire 3*b* carries a positive voltage of, for example 4 kV during charging. Consequently, a substantially inhomogeneous electric field occurs around the wire, which field causes a gas discharge. During the gas discharge the air molecules in the vicinity of the wire 3*b* are ionized. Through the meshes of said grid the positive charge carriers thus generated reach the surface of the X-ray image converter with the photoconductor and charge the latter. When the photoconductor has reached the potential of the grounded housing 3*a*, practically no further positive charge carriers will reach the photoconductor.

The supporting member 11 is stationary during an X-ray exposure and its side facing the X-ray source 2 is exposed so that the conductivity of the photoconductor is increased and its surface is discharged in conformity with the intensity of the X-rays, thus producing a corresponding charge pattern.

After an X-ray exposure, the charge pattern produced on the surface of the photoconductor by the X-ray exposure is read by means of a read unit 4. The read unit also extends parallel to the axis 12 of the X-ray image converter and includes a number of influence probes which are distributed in this direction and generate electric signals corresponding to the charge density on the surface. Instead of this capacitive read-out, it is also possible to read out the charge pattern by means of a TFT-matrix (see U.S. Pat. No. 5,396,072) or by laser scanning.

The invention can also be used for an X-ray image converter with a supporting member of different construction, for example a flat supporting member. For the FIGS. 2*a* . . . 4*b*, showing the succession of layers of the coating 10, therefore, a flat supporting member or substrate 11 is assumed. The substrate 11 may consist of aluminium provided with an oxide layer 110, but also of a glass member covered with a metal, for example aluminium, or with indium tin oxide. In that case there is provided a photoconductor layer 101 of selenium with a dopant of 0.5% by weight of arsenic in order to prevent recrystallization. The photoconductor layer 101 has a thickness of between 100 and 1000 $\mu$m, for example 500 $\mu$m. On its side which is remote from the substrate 1 the photoconductor layer 101 is covered with a passivation layer 102 which serves for mechanical and chemical protection of the photoconductor surface and may consist of, for example an organic lacquer or parapolyxylyl.

The side of the substrate 11 which faces the photoconductor 101, is provided with an oxide layer 110 which can be formed, for example wet chemically. The passivation layer 102 and the oxide layer 110 prevent the penetration of holes or electrons into the photoconductor layer 101 in the ideal case. In practice, however, it is inevitable that a current of charge carriers, for example electrons, is injected from the substrate into the photoconductor 101. This current is further intensified by space charges (charged defect spots in the vicinity of the interface) arising under the influence of the X-rays so that a disturbing memory effect occurs.

This influx of electrons from the substrate 11 is suppressed by means of an electron trapping layer 103 according to the invention. This may be a selenium layer which has a thickness of from 0.1 to 50 μm and a chlorine doping of from 1 to 1000 ppm (the thinner the layer, the higher the doping should be). Because of the doping, the trapping layer 103 will contain defect spots which collect electrons so that the electrical conductivity for electrons or the mobility of the electrons is reduced, whereas the electrical conductivity for holes, or the mobility of the holes, is increased.

Figure 2A:
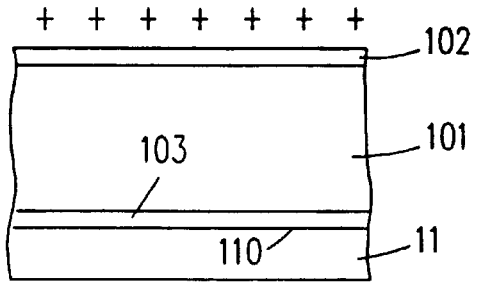
FIGS. 2*a* and *b* show a first embodiment.
Figure 2B:
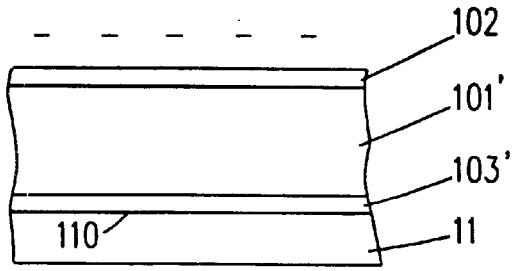

FIG. 2*b* shows an embodiment which is analogous to that of FIG. 2*a*, be it that the photoconductor now consists of a lead oxide layer 101' which may have a thickness which is smaller than that of the selenium layer 101 of FIG. 2*a*, for example a thickness of from 50 to 500 μμm, because the X-ray absorbtivity of lead oxide is higher than that of selenium. The substrate 11 can again consist of aluminium provided with an oxide layer 110, but also of a glass member which is coated with a metal, for example aluminium, or with indium tin oxide. However, it is advisable to charge the outer surface of the passivation layer 102 (which may have the same thickness and may consist of the same material as the layer 102 of the embodiment shown in FIG. 2*a*) negatively instead of positively, so that the substrate potential is positive with respect thereto. In a device as shown in FIG. 1 this is achieved by connecting the aluminium support 11 to a positive direct voltage.

Because of this different polarity of charging, holes can be injected from the substrate 11 into the photoconductor 101'. Consequently, the trapping layer 103' between the substrate and the photoconductor must act as a hole trapping layer in FIG. 2*b*. Such a layer may have a thickness of from 0.1 to 50 μm and consist of selenium, doped with from 1 to 2000 ppm sodium, or of a lead oxide layer doped with hydrogen, or of a lead oxide layer which exhibits an oxygen deficiency relative to the stoichiometric ratio of lead and oxygen, i.e. which contains less oxygen atoms than lead atoms.

Figure 3A:
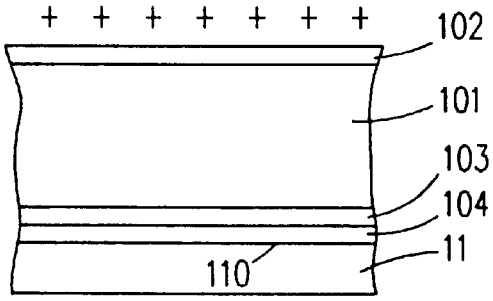
FIGS. 3*a* and *b* show a second embodiment.

The embodiment shown in FIG. 3*a* deviates from the embodiment shown in FIG. 2*a* in that a layer 104 is provided between the substrate 11 and the electron trapping layer 103; this layer 104 may have a thickness of up to 50 μm and consist of the same material as the photoconductor 101. The additional layer 104 acts as a buffer layer which separates the layers 103, 101, having imaging function, from the always slightly disturbed boundary surface between substrate and selenium.

Figure 3B:
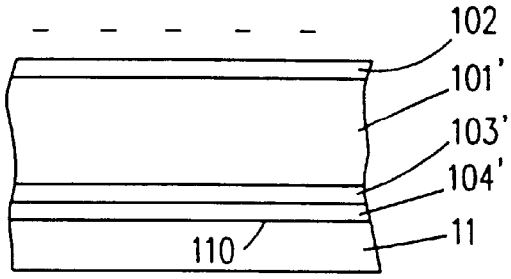

Analogously, the succession of layers shown in FIG. 3*b* deviates from the succession of layers shown in FIG. 2*b* in that a layer 104' of lead oxide (in stoichiometric ratio) which has a thickness of up to 50 μm is provided between the hole trapping layer 103' and the substrate, so that the hole current injected into the photoconductor 101 from the substrate is reduced even further.

Figure 4A:
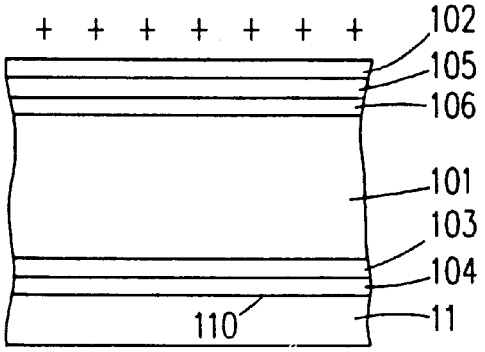
FIGS. 4*a* and *b* show a third embodiment for each time a selenium detector and a lead oxide detector, respectively.

The succession of layers shown in FIG. 4*a* deviates from that shown in FIG. 3*a* in that between the passivation layer 102 and the photoconductor 101 there is provided a layer 105 which has a thickness of between 0.1 and 20 μm, adjoins the passivation layer 102 and is made of the same material as the photoconductor 101, and that there is also provided a hole trapping layer 106 which adjoins the photoconductor. This layer may have a thickness of from 0.1 to 50 μm and be made of selenium doped with from 1 to 2000 ppm of sodium. The hole current injected into the photoconductor 101 is thus reduced.

Figure 4B:
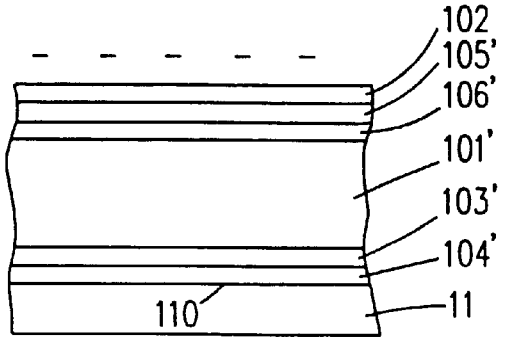

Analogously, the succession of layers shown in FIG. 4*b* deviates from that shown in FIG. 3*b* in that between the passivation layer 102 and the photoconductor layer there is provided a layer 105' which has a thickness of up to 20 μm and consists of (stoichiometric) lead oxide, and that there is also provided an electron trapping layer 106' which may have a thickness of between 0.1 and 50 μm and consist of selenium doped with 1 to 100 ppm of chlorine, or of a lead oxide layer with an oxygen excess.

When the charge carrier current penetrating the photoconductor 101 from the substrate 11 is small in comparison with the charge carrier flux injected into the photoconductor 101 from the opposite side, the layers 103 and 104 or 103' and 104' can also be dispensed with.

All references cited herein are incorporated herein by reference in their entirety and for all purposes to the same extent as if each individual publication or patent or patent application was specifically and individually indicated to be incorporated by reference in its entirety for all purposes.

What is claimed is:

1. A device for forming X-ray images comprising:

a photoconductor which at least partly absorbs X-rays, a substrate for the photoconductor which acts as an electrode, a first charge carrier trapping layer between the substrate and the photoconductor for reducing charge carriers injected into the photoconductor from the substrate, and a second charge carrier trapping layer on the side of the photoconductor which is remote from the substrate for reducing charge carriers injected into the photoconductor from the the remote side, wherein the first and second charge trapping layers reduce injection of charge carriers of opposite charges.

2. A device as claimed in claim 1, wherein the materials of the first and second trapping layers deviate from the material of the photoconductor by doping with additional substances so that defect spots for trapping injected charge carriers are formed in the first and second trapping layers.

3. A device as claimed in claim 1, further comprising a layer external to the second trapping layer whose thickness is substantially smaller than that of the photoconductor but has the same physical composition.

4. A device as claimed in claim 1, further comprising a passivation layer on the side of the photoconductor which is remote from the substrate and is external to the second trapping layer.

5. The device of claim 1 further comprising means for charging the photoconductor with a given polarity so that an electric field having a defined direction is generated in the photoconductor.

6. The device of claim 1 wherein the photoconductor consists mainly of selenium, wherein the first charge trapping layer reduces the injection of electrons, and wherein the second charge trapping layer reduces the injection of holes.

7. The device of claim 1 wherein the photoconductor consists mainly of lead oxide, wherein the first charge trapping layer reduces the injection of holes, and wherein the second charge trapping layer reduces the injection of electrons.

8. An X-ray imaging apparatus comprising:

an X-ray source for generating X-rays, and an X-ray image converter which comprises a photoconductor which at least partly absorbs the X-rays, a substrate for the photoconductor which acts as an electrode, means for charging the photoconductor with a single polarity so that an electric field having a defined direction is generated in the photoconductor, and a read unit for reading the charge pattern generated on the photoconductor by the X-rays, a first charge carrier trapping layer for reducing the charge carriers injected into the photoconductor from the outside between the substrate and the photoconductor, and a second charge carrier trapping layer for reducing the charge carriers injected into the photoconductor from the outside on the side of the photoconductor which is remote from the substrate, wherein the first and second charge trapping layers reduce injection of charge carriers of opposite charges.

9. A device for forming X-ray images comprising:

a photoconductor which at least partly absorbs X-rays and consists mainly of a material into which charge carriers of a first charge can be injected from contact with a conductor more easily than charge carriers of a second charge, a substrate for the photoconductor which acts as an electrode, and a charge carrier trapping layer between the substrate and the photoconductor for reducing the injection of charge carriers of the second charge into the photoconductor from the substrate.

10. A device for forming X-ray images comprising:

a photoconductor which at least partly absorbs X-rays and consists mainly of selenium, a substrate for the photoconductor which acts as an electrode, and a first charge carrier trapping layer between the substrate and the photoconductor for reducing the injection of electrons into the photoconductor from the substrate.

11. A device as claimed in claim 10 wherein the first trapping layer contains selenium with a chlorine or oxygen doping of less than 1000 ppm.

12. The device of claim 10 further comprising a second charge carrier trapping layer on the side of the photoconductor which is remote from the substrate for reducing injection of holes into the photoconductor from the remote side.

13. A device as claimed in claim 12 wherein the second trapping layer contains selenium with a sodium or hydrogen doping of less than 2000 ppm.

14. The device of claim 10 wherein the substrate consists mainly of aluminum whose surface facing the photoconductor is oxidized.

15. The device of claim 10 further comprising a second charge carrier trapping layer on the side of the photoconductor which is remote from the substrate for reducing injection of electrons into the photoconductor from the remote side.

16. A device as claimed in claim 15 wherein the second trapping layer contains mainly selenium with a chlorine or oxygen doping of less than 1000 ppm, or mainly lead oxide with more oxygen atoms that lead atoms.

17. A device for forming X-ray images comprising:

a photoconductor which at least partly absorbs X-rays and consists mainly of lead oxide, a substrate for the photoconductor which acts as an electrode, and a first charge carrier trapping layer between the substrate and the photoconductor for reducing the injection of holes into the photoconductor from the substrate.

18. A device as claimed in claim 17 wherein the first trapping layer contains mainly lead oxide with fewer oxygen atoms than lead atoms.

19. A device as claimed in claim 17 wherein the first trapping layer contains selenium with a sodium or hydrogen doping of less than 2000 ppm.

20. The device of claim 17 wherein the substrate consists mainly of aluminum whose surface facing the photoconductor is oxidized.

* * * * *